US005123151A

United States Patent [19]

Uehara et al.

[11] Patent Number: 5,123,151

[45] Date of Patent: Jun. 23, 1992

[54] ELASTIC FIXING ROLL WITH EXCELLENT RELEASE PROPERTY

[75] Inventors: Yasuhiro Uehara; Yoshio Shoji; Michiaki Yasuno, all of Kanagawa; Hiroshi Kato; Hiroyasu Kikukawa, both of Okayama, all of Japan

[73] Assignees: Fuji Xerox Co., Ltd.; Japan Gore-Tex Inc., both of Tokyo, Japan

[21] Appl. No.: 638,398

[22] Filed: Jan. 7, 1991

[30] Foreign Application Priority Data

Jan. 6, 1990 [JP] Japan ..... 2-236

[51] Int. Cl.[5] ..... G03G 15/20

[52] U.S. Cl. ..... 29/130; 355/282; 355/284; 29/132; 219/216

[58] Field of Search ..... 29/130, 132; 355/282, 355/284, 289, 290; 432/60; 219/216, 388; 118/60; 428/339, 906, 335

[56] References Cited

U.S. PATENT DOCUMENTS

| | | | |
|---|---|---|---|
| 3,437,032 | 4/1969 | Manghirmalani | 29/130 X |
| 4,064,313 | 12/1977 | Takiguchi et al. | 29/132 X |
| 4,078,286 | 3/1978 | Takiguichi | 29/132 |
| 4,257,699 | 3/1981 | Lentz | 29/132 X |
| 4,272,179 | 6/1981 | Seanor | 29/132 X |
| 4,372,246 | 2/1983 | Azar et al. | 29/132 X |
| 4,375,505 | 3/1983 | Newkirk | 29/130 X |
| 4,518,655 | 5/1985 | Henry et al. | 29/132 X |
| 4,521,095 | 6/1985 | Mayer | 29/132 X |
| 4,568,275 | 2/1986 | Sakurai | 29/130 X |
| 4,844,953 | 7/1989 | Kato et al. | 29/132 X |
| 4,883,715 | 11/1989 | Kuge et al. | 29/132 X |
| 4,887,340 | 12/1989 | Kato et al. | 29/130 |
| 5,011,401 | 4/1991 | Sakurai et al. | 29/132 X |
| 5,014,406 | 5/1991 | Kato et al. | 29/130 |

FOREIGN PATENT DOCUMENTS

| | | | |
|---|---|---|---|
| 0186314A3 | 7/1986 | European Pat. Off. . | |
| 0302741A3 | 2/1989 | European Pat. Off. . | |
| 58-84216 | 5/1983 | Japan | 29/130 |

OTHER PUBLICATIONS

Patent Abstracts of Japan, vol. 13, No. 358 (P-916), Aug. 10, 1989 for Japanese Patent Document 1-118871.

Patent Abstracts of Japan, vol. 8, No. 183 (P-296), Aug. 23, 1984 for Japanese Patent Document 59-74578.

Patent Abstracts of Japan, vol. 12, No. 284 (P-740), Aug. 4, 1988 for Japanese Patent Document 63-63075.

Patent Abstracts of Japan, vol. 13, No. 505 (P-959), Nov. 14, 1989 for Japanese Patent Document 1-205188.

Patent Abstracts of Japan, vol. 12, No. 171 for Japanese Patent Document 62-285839, first published Dec. 11, 1987.

Patent Abstracts of Japan, vol. 13, No. 149 (P-855), Apr. 12, 1989 for Japanese Patent Documentn 63-311371.

*Primary Examiner*—R. L. Moses

*Attorney, Agent, or Firm*—Finnegan, Henderson, Farabow, Garrett and Dunner

[57] ABSTRACT

An elastic roll of the first embodiment comprises an elastic body layer formed in a thickness not less than 200 μm on a metal core bar; and a covering layer with a release property formed in a thickness ranging from 3 μm to 200 μm on the surface of the elastic body, the covering layer being formed of a composite material composed of fibrillated polytetrafluoroethylene and elastomer having releasing properties. An elastic fixing roll of second embodiment comprises a heat-conductive elastic body layer formed of heat-resistant elastomer in a thickness not less than 200 μm on a metal core bar; an oil-resistant layer formed of oil-resistant elastomer in a layer thickness ranging from 3 μm to 200 μm on the elastic body layer; and a covering layer having a release property and formed of a composite material composed of fibrillated polytetrafluoroethylene and elastomer with a release property in a thickness ranging from 3 μm to 200 μm on the oil-resistant layer.

10 Claims, 1 Drawing Sheet

ELASTIC FIXING ROLL WITH EXCELLENT RELEASE PROPERTY

BACKGROUND OF THE INVENTION

The present invention relates to an elastic fixing roll which, being favorably applicable as a fixing roll in an electrophotographic copying machine, as a roll in a printing machine, or as a platen roll in a printer, and so forth, is capable of achieving an excellent release property.

For the rolls, platen rolls, or the like in printing machines, urethane rubber, EP rubber, silicone rubber, and so forth have been conventionally used, and silicon rubber rolls, fluororubber rolls, etc. are known to be in use as the fixing rolls in electrophotographic copying machines. However, as these types of rolls fail to achieve any sufficient release property even when they are used together with toners having features favorable to the release of paper from the rolls, a non-elastic roll covered with fluororesin, an elastic roll with a shrink-fit fluororesin tube covering its surface, or the like have been proposed. Also, another type of roll hitherto proposed is an elastic roll with a layer of fluororesin powder on its surface by coating a mixture of fluororubber and fluororesin powder thereon and baking the mixture.

Moreover, it has been in practice to coat release oil, generally, silicone oil, on the surface of the fixing roll in the process of the fixing operation in an electrophotographic copying machine, thereby improving the release property of the fixing roll. In such a case, however, it is necessary to prevent the fixing roll from swelling, which occurs as the result of the permeation of the silicone oil into the inside of the roll. For this purpose, such fixing rolls as an elastic roll with its surface covered with a shrink-fit fluororesin tube or the like and a roll (Japanese Patent Laid Open No. 205188/1989) made by forming a silicone rubber layer, a fluororubber layer or a fluoro-silicone rubber layer, and a silicone rubber layer in the stated order on a metal core bar have hitherto been proposed.

In the meanwhile, Japanese Patent Laid Open No. 285839/1987 discloses an elastic roll which the present inventors proposed. This elastic roll is made by soaking heat-resistant elastomer material in fibrillated polytetrafluoroethylene, particularly, extensible porous polytetrafluoroethylene, and joining these and thereby forming a covering layer on a metal core bar.

Now, the rolls, platen rolls, etc. which are made of urethane rubber, EP rubber, silicone rubber, or the like for use in printing machines, are not necessarily favorable in view of release property, though they offer favorable elasticity, so that such rolls have caused problems that they are liable to troubles such as the sticking of paper pieces to the roll and the winding of paper around the roll.

Also, particularly among the fixing rolls for electrophotographic copying machines, non-elastic rolls covered with fluororesin have the shortcoming that they lack in elasticity, and an elastic roll with its surface covered with a shrink-fit fluororesin tube is not necessarily satisfactory in terms of the elasticity of its surface because such a roll has small extensibility as the fluororesin is hard. Moreover, a roll with a layer of fluororesin powder formed on its surface achieves a favorable level both in its elasticity and its release property in the initial period following its installation, but the service life of the roll in respect of its release property is short since the fluororesin powder on its surface is liable to separate and to fall off from the roll.

Also, a roll with a silicone rubber layer formed over a fluororubber layer or a fluoro-silicone rubber layer, as the roll described in Japanese Patent Laid Open No. 205188/1989, is liable to the problem that since the silicon rubber layer on the surface of the roll does not have sufficient strength, the roll suffers for decline in the release property if the amount of the filling agent is increased in order to increase the strength of the surface layer, and also that since the roll does not have any sufficient adhesive strength between the silicone rubber layer and the fluororubber layer or the fluoro-silicone rubber layer, repeated fixing operations with repeated applications of silicone oil result in the growth of cracks in the silicone rubber layer on the surface, causing the separation of the surface layer in the worst case.

On the other hand, the elastic roll disclosed in Japanese Patent Laid Open No. 285839/1987 achieves very good release property and also realizes favorable affinity with silicone oil and favorable resistance to swelling, but is poor in its elasticity characteristics and inferior particularly in its elasticity recovering power. Additionally, the roll has another problem in that it is poor in its thermal conductivity, so that the surface temperature of the roll is lowered particularly in continuous copying operations.

SUMMARY OF THE INVENTION

The present invention has been made in view of the above-mentioned problems found with the rolls made in accordance with the prior art.

The object of the present invention is, therefore, to provide an elastic roll which can achieve both favorable elasticity and excellent release property.

Another object of the present invention is to provide an elastic fixing roll with little liability to the swelling of the roll caused by silicone oil or the like, with favorable properties in release, paper separation, fixing, and color development, and with excellent durability.

The present inventors have completed the present invention as the result of their repeated efforts to overcome the disadvantages associated with elasticity and thermal conductivity, taking notice of the excellent characteristics found in a composite material prepared by soaking and joining the above-mentioned fibrillated polytetrafluoroethylene, particularly, extensible porous polytetrafluoroetylene with elastomer having favorable release property, namely, the characteristics that the material has sufficient mechanical strength while it is pliable and also that it has excellent resistant to oil while it has affinity to oil.

A roll according to the first embodiment of the present invention is an elastic roll having a layer construction composed of two layers, and this elastic roll is characterized by including an elastic body layer, which is formed in a thickness not less than 200 μm on a metal core bar, and a covering layer with release property, which is formed in a thickness ranging from 3 μm to 200 μm of a composite material made of fibrillated polytetrafluoroethylene and elastomer with release property on the surface of the elastic body just mentioned.

A roll according to the second embodiment of the present invention is an elastic fixing roll having a layer construction composed of three layers, and this fixing roll is characterized by including a heat-conductive elastic body layer, which is formed of heat-resistant elastomer in a thickness not less than 200 μm on a metal core bar, an oil-resistant layer, which is composed of elastomer having resistance to oil in a thickness ranging from 3 μm to 200 μm, and a covering layer with release property, which is formed in a thickness ranging from 3 μm to 200 μm of a composite material composed of fibrillated polytetrafluoroethylene and elastomer with release property.

DETAILED DESCRIPTION OF THE INVENTION

Figure 1:
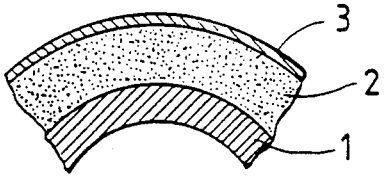
FIG. 1 is a sectional view of an elastic roll with two layers according to the first embodiment of the present invention.

First, the elastic roll with two layers according to the first embodiment of the present invention will be described.

The elastic body layer formed on a metal core bar may be a material freely selected in accordance with the specific use so long as it is an elastic material in ordinary use. For example, diene rubber, styrene-butadiene rubber, ethylene-propylene rubber, urethane rubber, and so forth, which are ordinary rubber materials, may be used, and also such heat-resistant elastomers as silicone rubber, fluororubber, and fluoro-silicone rubber may be used.

In the use of an elastic roll as the fixing roll of an electrophotographic copying machine, with silicon oil being coated on the surface of the roll, the covering layer on the surface of the roll, which has a release property, is scarcely given any influence, such as swelling, from the silicone oil, and yet the silicone oil reaches to the elastic body layer formed on the metal core bar, permeating through this covering layer. Thus, the elastic body layer should be made of elastomer having resistance to oil as well as thermal conductivity and resistance to heat, when the elastic roll according to the present invention is to be used for the application mentioned above, namely, it is a fixing roll for use in an electrophotographic copying machine to be operated with silicone oil being coated on the surface of the roll. As heat-resistant and oil-resistant elastomers, oil-resistant silicone rubber, fluoro-silicone rubber, and so forth may be exemplified.

According to the present invention, it is required that the elastic body layer should have a thickness not less than 200 μm, and such a thickness can secure the effectiveness of the elasticity in the elastic material mentioned above.

The covering layer with a paper separating feature, which is formed over the above-mentioned elastic body layer, is made of a composite material of fibrillated polytetrafluoroethylene and elastomer having a release property. The "fibrillated polytetrafluoroethylene" means polytetrafluoroetthylene formed into fibrils by the action of the shearing force generated by extrusion, pressurized rolling, kneading, expanding, and so forth working on the polytetrafluoroethylene.

For the elastomers which have a release property and may be compounded with the fibrillated polytetrafluoroethylene in the embodiment of the present invention, elastomers of the room temperature vulcanizing type (RTV) and those of the low temperature vulcanizing type (LTV) can be used, and, specifically, RTV and LTV silicone rubbers, fluororubber, fluoro-silicone rubber, and so forth may be cited.

Also, these elastomers, which have a release property, may be mixed with release oil, such as silicone oil, in order to intensify the release property. Moreover, it is also possible to include in their composition pulverized carbon black, graphite, boron nitride, alumina, silica, etc. in order to develop thermal conductivity and other features in the composite material.

According to the present invention, the thickness of the covering layer with a paper releasing feature is to be set in the range from 3 μm to 200 μm. Any thickness of the layer less than 3 μm will be insufficient from the viewpoint of durability.

The covering layer with a release property according to the present invention can be formed on the surface of the elastic roll, for example, by the following procedure. Namely, after the above-mentioned elastomer having a release property and polytetrafluoroethylene are mixed in the desired ratio, the compounded material is to be shaped by any ordinary shaping process; for example, it can be kneaded and thereafter formed into a sheet by being expanded under pressure with rolls, or it can be extruded into a sheet form. Then, the composite material thus shaped into a sheet form can be wound around the surface of the elastic body layer which has been processed appropriately, by such processes as primer coating, for improvements on its contact properties, and, after the elastomer is hardened, the surface of the composite material is finished by grinding and polishing.

Furthermore, a more desirable process consists of producing an expanded porous polytetrafluoroethylene film composed of fibrillated polytetrafluoroethylene by expanding unbaked polytetrafluoroethylene in advance, soaking this porous film in the above-mentioned elastomer having a release property to fill the voids in the porous film with the elastomer, and then hardening the soaked film. More specifically, the covering layer is produced by expanding unbaked polytetra-fluoroethylene film in advance to produce an expanding porous polytetrafluoroethylene film rich in tenacity and pliability and having a film thickness ranging from 3 μm to 200 μm, a void ratio ranging from 30% to 98%, and a pit diameter ranging from 0.02 μm to 15 μm, soaking the film with one or more kinds of silicone rubber, fluororubber, and fluoro-silicone rubber, thereby filling the voids in this film with such rubber, so that the rubber is held in the voids, thereafter wrapping the film around the surface of the roll having an elastic body layer processed for improvements on its contact properties, and thereafter hardening the roll by applying heat thereto. Also, the covering layer may be produced by coating adhesive agent on one side of expanded porous polytetrafluoroethylene film in advance, soaking the film with elastomer having a release property in the same manner as in the case described above, or further hardening the elastomer to form a film of composite material with adhesive agent, and wrapping this film around the surface of the roll having an elastic body layer on it, with the surface where the adhesive agent is placed being directed towards the elastic body layer. Moreover, the cover, layer may be formed by wrapping an expanded porous polytetrafluoroethylene film or an expanded porous polytetrafluoroethylene film with adhesive agent around the surface of the roll having an elastic body layer processed by primer coating and so forth for improvements on its contact properties in advance, fixing or joining them together, then soaking these with elastomer having a release property in the same manner as in the case described above, and thereafter hardening the film.

Now that the covering layer with a release property produced according to the present invention in the manner described hereinabove is composed of fibrillated polytetrafluoroethylene, which forms the skeletal structure, and elastomer, such as silicone rubber, fluororubber, and fluoro-silicone rubber, with a release property, the layer achieves improved release property owing to the release property of the polytetrafluoroethylene added onto the release property of the elastomer. In addition, the layer offers greater mechanical strength and increased durability achieved by the fibrillated tissue structure of the polytetrafluoroethylene film.

Next, the elastic film with three layers according to the second embodiment of the present invention will be described.

The elastic body layer formed on a metal core bar is composed of heat-resistant elastomer with resistance to oil and is formed, for example, of silicone rubber or the like of the high temperature vulcanizing type (HTV). The thickness of this elastic body layer should desirably be not less than 200 μm, but any excessively large thickness will cause such problems as a deterioration of thermal conductivity. Thus, it is desirable to set the thickness of the elastic body layer at 5 mm or less.

On the surface of the elastic body layer mentioned above, an oil-resistant layer composed of elastomer having resistance to oil is provided. For the elastomer having resistance to oil, oil-resistant silicone rubber, fluororubber, fluoro-silicone rubber, and so forth may be used. The thickness of the oil-resistant layer can be any thickness sufficient for inhibiting the intrusion of the silicone oil, and it is usually desirable to set the thickness in the range from 3 μm to 200 μm.

On the oil-resistant layer, a covering layer with a release property, which has a thickness of 3–200 μm and is formed of a composite of fibrillated polytetrafluoroethylene and elastomer with a release property as described above, is formed. The covering layer is produced in the same manner as described above.

The elastic roll having the layer construction of three layers is appropriately used as the fixing roll in an electrophotographic copying machine in which the roll is used while silicone oil is coated on the surface of the roll.

In the elastic roll with two layers according to the first embodiment of the present invention, the elasticity or elasticity and thermal conductivity of the roll are achieved primarily by the elastic body layer formed on the metal core bar while the release property is dependent on the covering layer having a release property and set on the surface of the elastic body layer. Since, as this covering layer with the release property has sufficient pliability and strength, it does not interfere with the elasticity of the elastic body layer. Also, since this covering layer with a release property is a composite material formed of polytetrafluoroethylene, which has an essentially excellent release property, and elastomer, which has a release property, the covering layer demonstrates its release property superior to the release property inherent in the elastomer, and offers good durability. Therefore, the elastic roll in the embodiment of the present invention is capable of achieving both elasticity and a superior release property.

Also, in the roll with three layers according to the second embodiment of the present invention, the silicone oil coated on the covering layer with a release property is intercepted by the oil-resistant layer, so that the elastic body layer composed of heat-resistant elastomer, which is positioned under the oil-resistant layer, will not be damaged.

Then, the above embodiments will be described with reference to the accompanying drawings.

Figure 2:
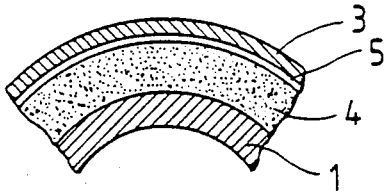
FIG. 2 is a sectional view of the elastic fixing roll with the three layers according to the second embodiment of present invention.

FIG. 1 is a sectional view of the elastic roll with the two layer construction according to the first embodiment of the present invention. FIG. 1 shows a metal core bar 1, an elastic body layer 2, and a covering layer 3 with a release property. FIG. 2 is a sectional view of the elastic fixing roll with a three layer construction according to the second embodiment of the present invention. FIG. 2 further shows an elastic body layer 4 with thermal conductivity and an oil-resistant layer 5.

Next, each of the above-described elastic rolls according to the present invention will be described with reference to manufacturing examples.

EXAMPLE 1

(Elastic Roll With Two Layer Construction)

Referring now to FIG. 1, in one embodiment of the invention, stainless steel core bar (shown as core bar 1) in the diameter of 12 mm, with adhesive agent for rubber coated on its surface, was inserted into the inside hole of a cylindrical rubber (shown as elastic body layer 2) in the inside diameter of 12 mm and in the wall thickness of 19 mm and set together by adhesion. Thereafter, the cylindrical rubber layer was finished by grinding and polishing its surface, and thus a rubber roll with a shaft in the outside diameter of 50 mm was produced. Subsequently, after adhesive agent for rubber was applied on the surface of this roll, expanded porous polytetrafluoroethylene film (with a product name "Gore-tex" and made by Japan Gore-tex Inc.) which had the thickness of 10 μm and the void ratio of 70% was wrapped around the surface of the roll seven turns in the manner of making rollcake, and the end of the film was secured. The extended porous polyetrafluoroethylene film is shown as covering layer 3 in FIG. 1. Then, this expanded porous polytetrafluoroethylene film (shown as covering layer 3) was soaked with a mixture of RTV silicone rubber with silicone oil of the viscosity of 1000 cps in a mixing ratio of 10%, the voids in the film being thereby filled with the mixture. Thereafter, the excessive amount of the mixture was wiped off, and the film thus processed was heated at 60° C. for ten hours to cross-link the silicone rubber. Thus, an elastic roll was produced.

EXAMPLE 2

(Elastic Roll With Two Layer Construction)

Again referring to FIG. 1 core bar 1 in the diameter of 8 mm was covered with foamed polyurethane (shown as elastic body layer 2) in the thickness of 12 mm and containing isolated foams therein, so that an elastic foamed polyurethane roll in the outside diameter of 32 mm was prepared.

Apart from this, polyurethane type adhesive agent was coated on the surface of expanded porous polytetrafluoroethylene film (shown as covering layer 3) in the thickness of 12 μm and in the void ratio of 80%. Then, the adhesive agent was dried, and a layer was thereby formed in the thickness of 5 μm, and an expanded porous polytetrafluoroethylene film (shown as covering layer 3) was produced with the adhesive agent coated on its surface. Then, this film was wrapped one turn in the overlapping width of 3 mm around the surface of the above-mentioned elastic roll, and the film and the roll were then joined together by rolling it on an iron plate at the temperature of 150° C. Thereafter, this roll was gradually soaked in RTV silicone rubber solution, so that the voids in the expanded porous polytetrafluoroethylene film (shown as covering layer 3) were filled up with the RTV silicone rubber. The superfluous amount of the RTV silicone rubber remaining on the surface of the roll was wiped off, and the RTV silicone rubber was cross-linked by heating the roll at 120° C. for one hour, and thus an elastic roll was produced.

EXAMPLE 3

(Elastic Roll With Two Layer Construction)

Referring to FIG. 1, after a cover was formed of HTV silicone rubber on the surface of a hollow metal cylindrical core (shown as core bar 1) made of stainless steel with a coat of primer formed between the cover and the core surface, the surface of the covering rubber was finished by grinding and polishing, so that an elastic body layer 2 was formed in the thickness of 3.5 mm. Next, primer for silicone rubber was coated over the surface of the elastic body layer 2 just formed, and material in the form of a tape 3 cm in width and made of expanded porous polytetrafluoroethylene film (shown as covering layer 3) with the void ratio of 92% and the thickness of 4 μm was wrapped over the elastic body layer 2 diagonally at the pitch of 1.5 cm. Next, this expanded porous polytetrafluoroethylene film (shown as covering layer 3) was soaked with RTV silicone rubber, and the voids in the film were thereby filled with the silicone rubber, and, after the excessive amount of the RTV silicone rubber was wiped off, an elastic roll was produced by hardening the film and contacting the film with the elastic body layer 2 at the same time by heating them at 120 ° C. for three hours.

With a heater installed in the hollow area of this elastic roll, the roll was operated as a heating and fixing roll in an electrophotographic copying machine, and the elastic roll was evaluated with using release-agent containing type toner at a heating temperature in the range from 150° C. to 220° C. As the result, vivid copied images without gloss, which are inherent to copied images produced with an elastic roll, could be obtained. In addition, the offset phenomenon, which tends to occur in consequence of inferior release property, was not observed. Moreover, the state did not change even after ten thousand sheets of paper had been passed.

EXAMPLE 4

(Elastic Roll With Two Layer Construction)

Referring once again to FIG. 1, an elastic roll was produced by the same procedure as in the case of Example 3, with the exception that the voids in the expanded porous polytetrafluoroethylene film (shown as covering layer 3) were filled with fluoro-silicone rubber of the RTV type instead of the RTV silicone rubber.

This elastic roll was evaluated in the same manner as in Example 3, and, similarly, favorable results were obtained on both elasticity and release property. Moreover, this elastic roll was tested in the same manner for its evaluation, with coating silicone oil on the surface of the elastic roll, and it was found that this elastic roll produced favorable copied images even after the passing of twenty thousand sheets of copying paper without being affected with swelling or the like due to the action of the silicone oil.

EXAMPLE 5

(Elastic Fixing Roll With Three Layer Construction)

FIG. 2 shows a second embodiment of the invention. A hollow cylinder made of aluminium in the outside diameter of 42 mm was prepared for use as the metal core bar, 1 and HTV silicone rubber (shown as elastic body layer 4 with thermal conductivity); was baked and hardened on the surface of the cylinder through primer for silicone rubber. Then, the surface was finished so that an intermediate covering layer (for the elastic body layer 4); in the thickness of 3.5 mm was produced. In succession, liquid fluororubber was coated on this surface through primer for fluororubber and was then hardened to form an oil-resistant layers made of fluororubber in the layer thickness of 50 μm, so that an elastic roll with an oil-resistant construction was formed. Next, primer for silicone rubber was coated on the surface of this roll, and expanded porous polytetrafluoroethylene film (shown as covering layer 3) in the thickness of 5 μm was thereafter wrapped two turns around the roll in the manner of making vinegared rice rolled in laver, and the end of the film was secured. Subsequently, the voids in the expanded porous polytetrafluoroethylene film were filled with RTV silicone rubber by coating RTV silicone rubber on the surface of this roll under a reduced pressure. After the excessive amount of the RTV silicone was wiped off under the normal pressure, the rubber was heated at 120° C. for two hours to harden and adhere onto the surface of the elastic roll, so that a release layer was thus formed, and an elastic fixing roll was produced.

Figure 3:
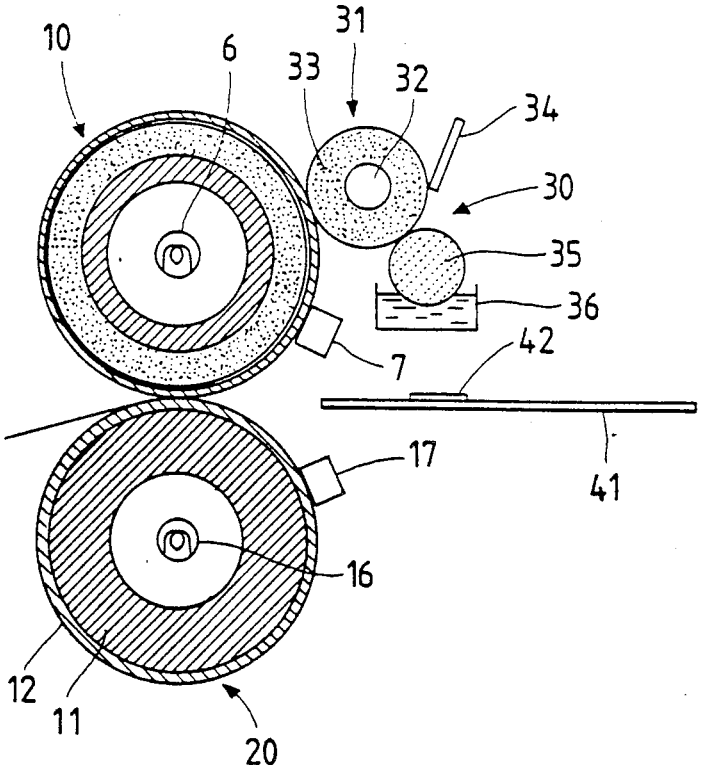
FIG. 3 is a schematic configuration view illustrating the fixing unit equipped with an elastic fixing roll according to the present invention.

This elastic fixing roll was built into a full-color copying machine as illustrated in FIG. 3, and a running test was conducted on the roll, with silicone oil being coated on the surface of the roll.

The pressurizing roll 20, which rotates in contact with the elastic fixing roll 10, was produced by coating and baking a polytetrafluoroethylene film 12 (product name: Teflon; made by Dupont Corp.) in the thickness of 40 μm on the surface of a metal core 11 made of aluminimum in the outside diameter of 50 mm. The pair of rolls 10 and 20 mentioned above were driven at the rotating speed of 160 mm/sec. in the contact width of 6 mm under the total load of 120 kg. Also, both these rolls were provided with infrared ray lamps 6 and 16 as heating sources, which were arranged in the inside areas of the rolls and controlled to maintain the temperature at 150° and 140° by temperature controllers not illustrated in the Figure. On the surface of the elastic fixing roll 10 mentioned above, an oil feeding unit 30 was installed for preventing the offsetting of the toner. The oil feeding unit 30 fed the oil from an oil pan 36 to an oil coating roll 31 via an oil pickup roll 35. The oil coating roll 31 was a roll produced by covering a metal core bar 32 made of aluminium with silicone rubber layer 33 in the thickness of 2 mm, and this roll 31 was provided with a blade member 34 set in a part of the outside surface of the roll. This oil coating roll 31 was designed always to feed a constant amount of oil to the fixing roll 10. Also illustrated in FIG. 3 are wiping devices 7 and 17, copying paper 41, and toner images 42.

In the fixing unit mentioned above, dimethyl silicone oil (for example, KF-96 made by Shinetsu Chemical Co., Ltd.) was used, and the fed amount of the oil was adjusted so that it would be 5 μl to 10 μl per copy in the standard A4 size.

Successive fixing tests were conducted with the fixing unit mentioned above under the fixing conditions given in the following:

copying speed: 10 sheets of standard A4 size copying paper per minute

Paper: Paper Type P (made by Fuji Xerox Corp.)

Toner composition: Polyester resin 95% by weight

Pigment 4% by weight, and change enhancing additive agent 1% by weight.

As the result of this series of tests, it was found that the swelling of the elastic roll due to the silicone oil did not occur even after fifty thousand sheets of paper had been passed, that cracks did not occur in the surface layer, and that the properties of the elastic roll in respect of release, paper separation, stability, and color development were favorable. It was also observed that the difference in level due to the film thickness in the end part of the wrapping of the expanded porous polytetrafluoroethylene film did not give any particular influence to the picture images.

Comparative Example 1

The same paper pass tests as those conducted in Example 5 were performed on the elastic fixing roll made in the oil-resistant construction as in Example 5 but without forming any release layer composed of expanded porous polytetrafluoroethylene and RTV silicone rubber on its surface. While the occurrence of swelling was not observed, it was found that troubles due to poor release property, such as the winding of copying paper and inferior color development, occurred in this case.

Comparative Example 2

A separating covering layer composed only of RTV silicone rubber in a thickness of approximately 20 μm was formed by directly coating RTV silicone rubber without using any expanded porous polytetrafluoroethylene on the surface of the elastic fixing roll made in an oil-resistant construction in the same manner as in Example 5. Also this roll was evaluated in the same manner as in Example 5, and it was found that cracks occurred in the separating covering layer on the surface of the roll after the processing of approximately 5,000 copies, and, additionally, a separation of the covering layer was observed in some part of the roll.

As described above, the elastic roll according to the present invention offers good durability, and both of elasticity and release property. Moreover, in case the elastic layer is formed of oil-resistant elastomer, or in case an oil-resistant layer is provided between the elastic layer and the covering layer with a release property, the elastic roll can effectively control the swelling of the roll by the action of silicone oil or the like. In addition, the elastic roll achieves favorable properties in any of release property, paper separating, fixing, and color development and offers excellent durability. Thus, the elastic roll according to this invention can show very significant industrial effects when it is used as the fixing roll in an electrophotographic copying machine.

What is claimed is:

1. An elastic roll, comprising:

an elastic body layer formed in a thickness not less than 200 μm on a metal core bar; and a covering layer with a release property formed in a thickness ranging from 3 μm to 200 μm on the surface of said elastic body layer, said covering layer being formed of a composite material composed of fibrillated polytetrafluoroethylene and elastomer having releasing properties.

2. An elastic roll according to claim 1, wherein said elastic body layer is formed of one selected from the group consisting of oil-resistant silicone rubber, fluororubber, and fluoro-silicone rubber.

3. An elastic roll according to claim 1, wherein said covering layer is composed of expanded, porous polytetrafluoroethylene film, and elastomer having a release property and filled in voids of said expanded porous polytetrafluoroethylene by soaking and hardening.

4. An elastic roll according to claim 1 or claim 2, wherein said elastomer is silicone rubber of normal temperature vulcanizing type.

5. An elastic roll according to claim 1 or claim 2, wherein said elastomer is either fluoro-silicone rubber or fluororubber.

6. An elastic fixing roll, comprising:

a heat-conductive elastic body layer formed of heat-resistant elastomer in a thickness not less than 200 μm on a metal core bar;

an oil-resistant layer formed of oil-resistant elastomer in a layer thickness ranging from 3 μm to 200 μm on said elastic body layer; and a covering layer having a release property and formed of a composite material composed of fibrillated polytetrafluoroethylene and elastomer with a release property in a thickness ranging from 3 μm to 200 μm on said oil-resistant layer.

7. An elastic fixing roll according to claim 6, wherein said heat-conductive elastic body layer is composed of one selected from the group consisting of heat-resistant silicone rubber, fluororubber, and fluoro-silicone rubber.

8. An elastic fixing roll according to claim 6, wherein said covering layer is composed of expanded porous polytetrafluoroethylene film, and elastomer having a release property filled in voids of said expanded porous polytetrafluoroethylene film by soaking and hardening.

9. An elastic fixing roll according to claim 6 or claim 7, wherein said elastomer is silicone rubber of normal temperature vulcanizing type.

10. An elastic fixing roll according to claim 6 or claim 7, wherein said elastomer is either fluoro-silicone rubber or fluororubber.

* * * * *